US005318294A

United States Patent [19]

Boroski

[11] Patent Number: 5,318,294

[45] Date of Patent: Jun. 7, 1994

[54] STICK AND BALL GAME AND METHOD

[76] Inventor: Michael Boroski, 63 Geissler Dr., Shelton, Conn. 06484

[21] Appl. No.: 128,089

[22] Filed: Sep. 29, 1993

[51] Int. Cl.[5] ..... A63B 59/00; A63B 65/12

[52] U.S. Cl. ..... 273/67 R; 273/327; 273/346; 273/412; 273/DIG. 30

[58] Field of Search ..... 273/327, 317, 318, 346, 273/412, 67 R, 67 DC, 77 B, DIG. 30

[56] References Cited

U.S. PATENT DOCUMENTS

| | | | |
|---|---|---|---|
| 4,163,554 | 8/1979 | Bernhardt | 273/77 B X |
| 4,752,076 | 6/1988 | Galinas, Jr. | 273/318 |
| 4,789,161 | 12/1988 | Waskelo | 273/327 |
| 4,826,173 | 5/1989 | Brown | 273/DIG. 30 X |
| 5,123,655 | 6/1992 | Rones | 273/346 |
| 5,213,324 | 5/1993 | Bowers | 273/26 R |

*Primary Examiner*—William H. Grieb
*Attorney, Agent, or Firm*—John H. Crozier

[57] ABSTRACT

A preferred embodiment, a ball launcher/catcher for a stick and ball game, including: an elongate base member having proximal and distal ends and an upper surface; a handle portion disposed at the proximal end of the base member; a first part of a hook-and-loop fabric system disposed on at least the upper surface of the distal end of the base member; and a padded intermediate portion disposed on the upper surface of the base member intermediate the proximal and distal ends of the base member. The game is played by adhering to the distal end of the base member a ball covered with a second part of the hook-and-loop fabric system; then, a first player grasping the handle portion in one hand and rotating the first ball launcher/catcher rearwardly; and then, the first player rapidly rotating the first ball launcher/catcher forwardly and whacking the intermediate portion against the heel of the first player's other hand, such as to transfer momentum to the ball, thereby separating the ball from the distal end of the first ball launcher/catcher and launching the ball in the air.

5 Claims, 3 Drawing Sheets

STICK AND BALL GAME AND METHOD

BACKGROUND OF THE INVENTION

1. Field of the Invention

The present invention relates to games generally and, more particularly, but not by way of limitation, to a novel stick and ball game.

2. Background Art

Games involving various types of sticks (or bats) and balls have been played for centuries and they are of continuing popularity. Especially popular are those games which can be played by a small number of people in an informal setting.

Accordingly, it is a principal object of the present invention to provide a stick and ball game that is interesting and challenging.

It is a further object of the invention to provide such a stick and ball game the apparatus of which is economically and easily constructed.

It is another object of the invention to provide such a stick and ball game that can be played by one or any number of more players.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a ball launcher/catcher for a stick and ball game, comprising: an elongate base member having proximal and distal ends and an upper surface; a handle portion disposed at the proximal end of said base member; a first part of a hook-and-loop fabric system disposed on at least said upper surface of said distal end of said base member; and a padded intermediate portion disposed on said upper surface of said base member intermediate said proximal and distal ends of said base member. The game is played by adhering to said distal end of said base member a ball covered with a second part of said hook-and-loop fabric system; then, a first player grasping said handle portion in one hand and rotating said first ball launcher/catcher rearwardly; and then, said first player rapidly rotating said first ball launcher/-catcher forwardly and whacking said intermediate portion against the heel of said first player's other hand, such as to transfer momentum to said ball, thereby separating said ball from said distal end of said first ball launcher/catcher and launching said ball in the air.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
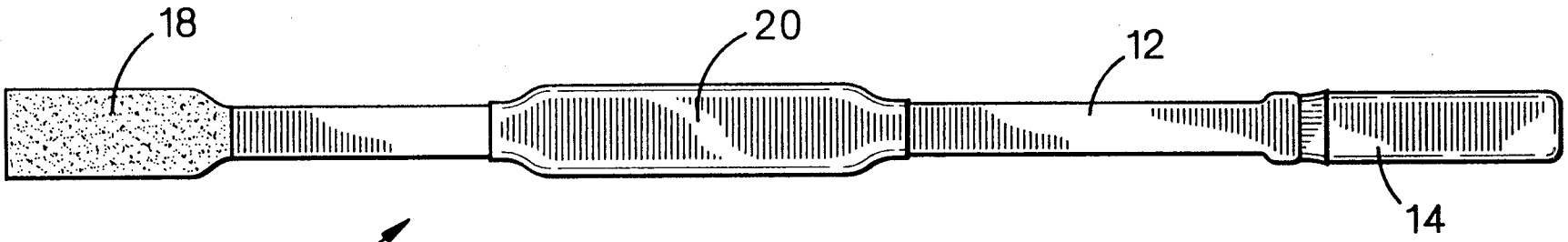
FIG. 1 is a top plan view of a ball launcher/catcher according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
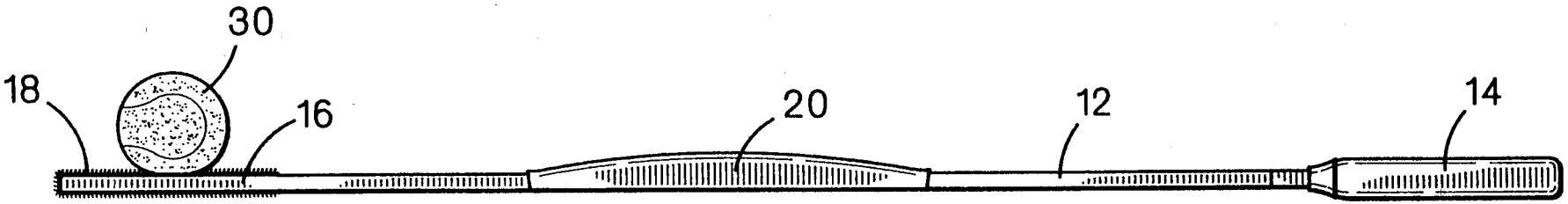
FIG. 2 is a side elevational view of the ball launcher/-catcher of FIG. 1.

FIGS. 1 and 2 illustrate a ball launcher/catcher, generally indicated by the reference numeral 10, constructed according to the present invention. Ball launcher/catcher 10 includes an elongate base member 12 having a padded handle portion 14 (FIG. 2) at the proximal end thereof and, at the distal end thereof, an enlarged, flat portion 16 having Velcro hook fabric 18 disposed on at least the upper surface thereof. Intermediate the proximal and distal ends of ball launcher/-catcher 10, but somewhat closer to the latter than the former, is an enlarged, padded intermediate portion 20. While intermediate portion 20 is shown padded on only one side thereof, it may be padded on both sides such that a game may be played with launcher/catcher 10 (as described below) without consideration as to which side of the launcher/catcher is used.

A ball 30 (FIG. 2) covered with Velcro loop fabric is provided which adheres to hook fabric 18 on the distal end of ball launcher/catcher 10.

Figure 3:
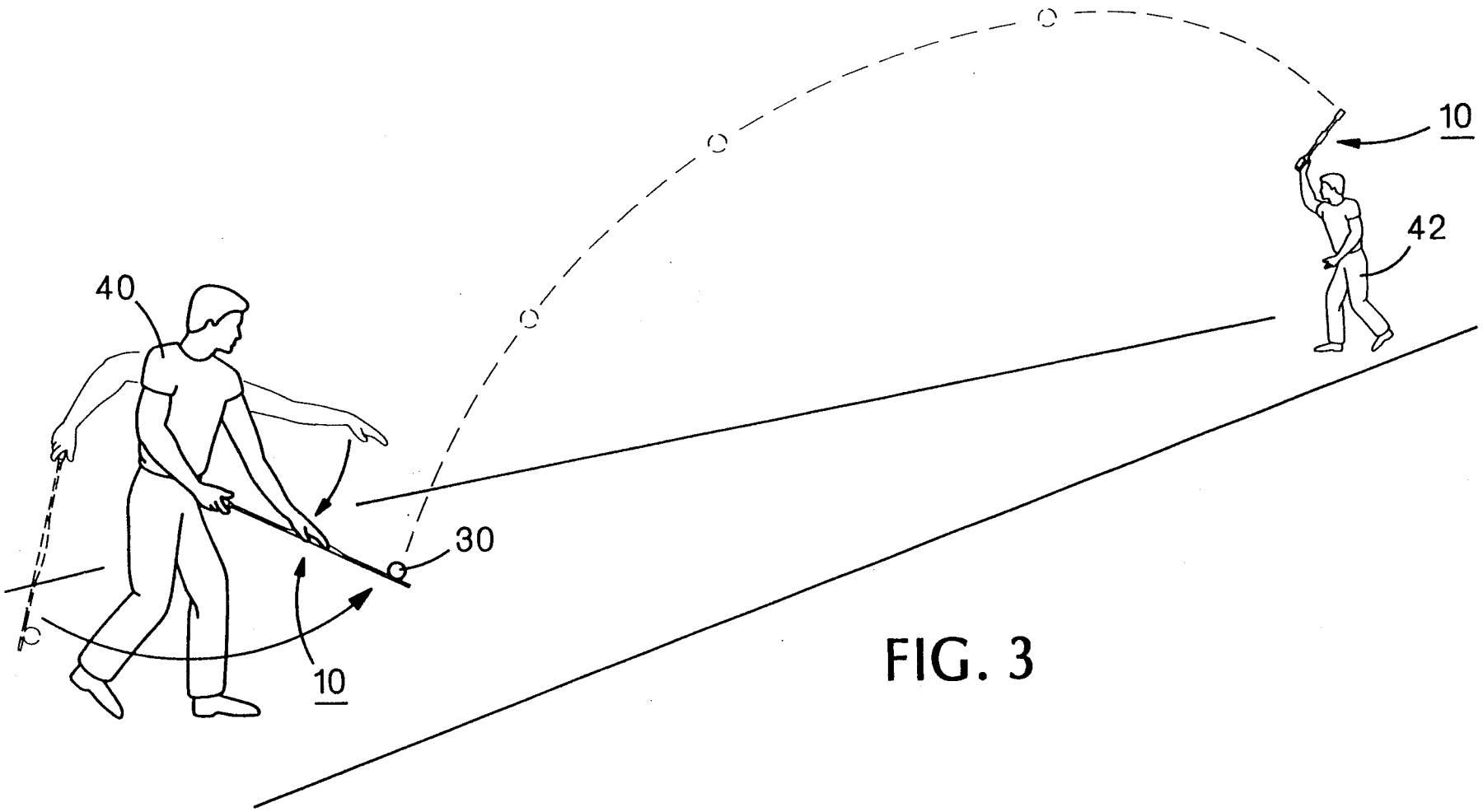
FIG. 3 is a perspective view of the game of the present invention being played by two players.
Figure 4:
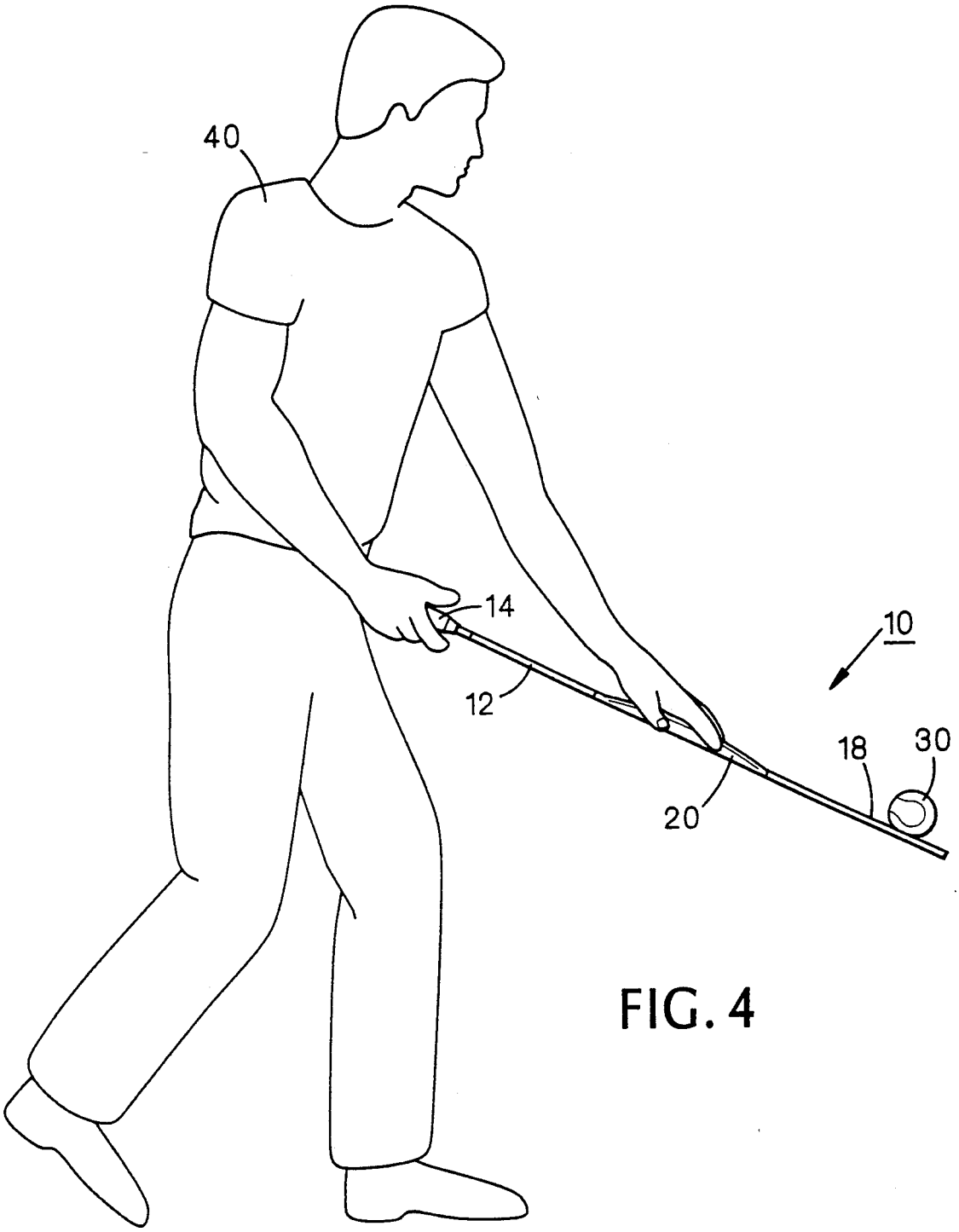
FIG. 4 is a side elevational view of an enlarged portion of FIG. 3.

FIGS. 3 and 4 illustrate how the game of the present invention may be played by a first player 40 and a second player 42. First player 40 grasps ball launcher/-catcher 10 in either hand, in this case, for example, his right hand, and rotates the ball launcher/catcher rearwardly to the approximate position shown in broken lines on FIG. 3. Then, first player 40 rapidly rotates ball launcher/catcher 10 forwardly and whacks padded portion 20 against the heel of his left hand. This transfers the momentum of the swinging action to ball 30 which thereby separates from the distal end of ball launcher/catcher 10 and is launched in the air, as shown in broken lines on FIG. 3. Second player 42, who has a similar ball launcher/catcher 10, then attempts to catch ball 30 on the distal end of his ball launcher/catcher by adhering the ball to hook and loop fabric 18 on either side of the distal end of his launcher/catcher. Second player 42 then may use the above procedure to return ball 30 to first player 40.

Alternative methods of launching ball 30 are starting with overhead or sidearm swings of launcher/catcher 10 with one hand, with the launching action of whacking padded intermediate portion 20 against the heel of the other hand, as described above.

Ball 30 may be launched a horizontal distance of from about 35 to over 200 feet, depending on the force with which it is launched. The game may also be played by a single player if ball 30 is launched in primarily vertical direction so that the single player may move under it and catch it with ball launcher/catcher 10.

Ball launcher 10 is preferably about 31 inches in length for adult players, but may be shorter for younger players, and is somewhat resilient. Preferred materials of construction for ball launcher/catcher 10 are wood, plastic, fiberglass, and aluminum. When ball launcher 10 is constructed of ash wood, the desired degree of resilience is attained when the unenlarged portion of base member is about 1⅛ inches wide by 5/16-inch thick.

Preferably, flat portion 16 is about 4 inches long by about $1\frac{3}{4}$ inches wide and intermediate portion 20 is about 6 inches long by about $1\frac{3}{4}$ inches wide.

Ball 30 is preferably slightly smaller than a tennis ball—about $2\frac{1}{4}$ inches in diameter—is formed from a resilient material, and is loosely filled with materials such as dried legumes, rice, or plastic pellets such that the weight of the ball is about $2\frac{1}{4}$ ounces. The size and weight of ball 30 may also be made larger or smaller and heavier or lighter, respectively.

Padded handle 14 and padded intermediate portion are vinyl covered.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A ball launcher/catcher for a stick and ball game, comprising:

(a) an elongate base member having proximal and distal ends and an upper surface;

(b) a handle portion disposed at the proximal end of said base member;

(c) a first part of a hook-and-loop fabric system disposed on at least said upper surface of said distal end of said base member; and (d) a padded intermediate portion disposed on said upper surface of said base member intermediate said proximal and distal ends of said base member; and wherein:

(e) said base member is formed from ash wood and is about $1\frac{1}{8}$ inches wide by 5/16 inch thick;

(f) said distal end of said base member is about 4 inches long by about $1\frac{3}{4}$ inches wide; and (g) said intermediate portion of said base member is about 6 inches long by about $1\frac{3}{4}$ inches wide.

2. A ball launcher/catcher, as defined in claim 1, wherein said intermediate portion is somewhat closer to said distal end than to said proximal end of said ball launcher/catcher.

3. A method of playing a stick and ball game, comprising:

(a) providing a first ball launcher/catcher comprising an elongate, semi-resilient base member having proximal and distal ends and an upper surface, a handle portion disposed at the proximal end of said base member, a first part of a hook-and-loop fabric system disposed on at least said upper surface of said distal end of said base member, and an intermediate portion disposed on said upper surface of said base member intermediate said proximal and distal ends of said base member;

(b) providing a ball covered with a second part of said hook-and-loop fabric system so as to adhere to said first part of said hook-and-loop fabric system;

(c) then, adhering said ball to said first part of said hook-and-fabric system on said distal end of said base member;

(d) then, a first player grasping said handle portion in one hand and rotating said first ball launcher/-catcher rearwardly; and (e) then, said first player rapidly rotating said first ball launcher/catcher forwardly and whacking said intermediate portion against the heel of said first player's other hand, such as to transfer momentum to said ball, thereby separating said ball from said distal end of said first ball launcher/catcher and launching said ball in the air.

4. A method of playing a stick and ball game, as defined in claim 3, further comprising:

(f) providing a second ball launcher/catcher comprising an elongate, semi-resilient base member having proximal and distal ends and an upper surface, a handle portion disposed at the proximal end of said base member, and a first part of a hook-and-loop fabric system disposed on at least said upper surface of said distal end of said base member;

(g) then, a second player grasping said handle portion of said second ball launcher/catcher and attempting to catch, on said first part of said hook-and-loop fabric system disposed on said upper surface of said distal end of said base member, said ball launched by said first player.

5. A method of playing a stick and ball, as defined in claim 3, further including the step of launching said ball 35 to over 200 feet.

* * * * *